US007540792B2

(12) United States Patent
Ananthakrishnan et al.

(10) Patent No.: US 7,540,792 B2
(45) Date of Patent: Jun. 2, 2009

(54) SWITCHING APPARATUS

(75) Inventors: Subramanyan Ananthakrishnan, Bangalore (IN); Kathiravan Dhandapani, Bangalore (IN); Avijit Saha, Kolkata (IN)

(73) Assignee: General Electric Company, Schenectady, NY (US)

( * ) Notice: Subject to any disclaimer, the term of this patent is extended or adjusted under 35 U.S.C. 154(b) by 158 days.

(21) Appl. No.: 11/462,896

(22) Filed: Aug. 7, 2006

(65) Prior Publication Data

US 2008/0055025 A1 Mar. 6, 2008

(51) Int. Cl.
*H01R 4/36* (2006.01)
*H01H 9/02* (2006.01)
*H01H 13/04* (2006.01)

(52) U.S. Cl. ..... 439/811; 335/202

(58) Field of Classification Search ..... 335/129–132, 335/127, 159–161, 202; 439/810–814
See application file for complete search history.

(56) References Cited

U.S. PATENT DOCUMENTS 1,580,562 A * 4/1926 Moore ..... 324/396
1,611,567 A * 12/1926 Sonen ..... 411/539
1,767,808 A * 6/1930 Nietman ..... 439/221
2,254,754 A * 9/1941 Reece ..... 439/269.2
2,570,753 A * 10/1951 Berg ..... 439/877
2,706,804 A 4/1955 Ziebell
3,340,497 A * 9/1967 Balint ..... 439/872
3,423,723 A * 1/1969 Kobryner ..... 439/858
3,585,576 A * 6/1971 Meyers ..... 439/746
3,733,574 A * 5/1973 Scoville et al. ..... 439/48
3,761,867 A * 9/1973 Churla ..... 439/413
3,861,780 A * 1/1975 Hobbs, II ..... 439/877
3,864,005 A * 2/1975 Klein ..... 439/812
3,891,298 A * 6/1975 Yorgin et al. ..... 439/620.08
3,945,709 A * 3/1976 Filson ..... 439/860
4,437,020 A 3/1984 Schroether
4,659,158 A * 4/1987 Sakamoto et al. ..... 439/507
4,699,445 A * 10/1987 Porta et al. ..... 439/698
4,739,293 A * 4/1988 Hurley et al. ..... 335/132

(Continued)

FOREIGN PATENT DOCUMENTS

JP 08130042 5/1996

(Continued)

OTHER PUBLICATIONS

Foreign Search Report. Reference 203950/12468. Application No. 07113400.1-2214. Mailed Nov. 9, 2007. 5 pages.

*Primary Examiner*—Lincoln Donovan
*Assistant Examiner*—Alexander Talpalatskiy

(57) ABSTRACT

A switching apparatus is disclosed. The apparatus comprises an electrical contactor including a set of main terminals per phase and an auxiliary switch including a set of auxiliary terminals per phase. Each set of the auxiliary terminals is electrically connected to a respective set of the main terminals via a resistance wire, such that each set of the auxiliary terminals is electrically connected in parallel with each respective set of the main terminals. Each resistance wire includes a first terminal at a first end configured to connect to one of the set of auxiliary terminals, and a second terminal at a second end configured to connect to a respective one of the set of main terminals. The second terminal of the resistance wire comprises a retention hook configured to hook onto the respective main terminal.

14 Claims, 4 Drawing Sheets

U.S. PATENT DOCUMENTS 4,775,337 A * 10/1988 Van Wagener et al. ..... 439/883
4,944,692 A * 7/1990 Allina ..... 439/517
4,992,765 A * 2/1991 Hirota et al. ..... 335/131
5,118,307 A * 6/1992 Knoop et al. ..... 439/607
5,206,789 A * 4/1993 Barbry ..... 361/634
5,483,213 A * 1/1996 Mueller et al. ..... 335/132
5,493,085 A * 2/1996 Kolberg et al. ..... 200/51 R
5,575,697 A * 11/1996 Kaedei ..... 439/883
5,689,143 A 11/1997 Nikles
5,872,498 A * 2/1999 Linek ..... 335/132
6,034,584 A * 3/2000 Hilfiker ..... 335/132
6,102,750 A * 8/2000 Little et al. ..... 439/813
6,283,770 B1 * 9/2001 Leung et al. ..... 439/92
6,285,271 B1 * 9/2001 Bauer et al. ..... 335/132
6,296,508 B1 * 10/2001 Kuwahara et al. ..... 439/353
6,361,382 B1 * 3/2002 Yamada et al. ..... 439/813
6,402,548 B1 * 6/2002 Ruiz et al. ..... 439/507
6,431,883 B2 * 8/2002 Pan ..... 439/79
6,716,052 B2 * 4/2004 Kane ..... 439/352
6,942,527 B1 * 9/2005 Lias et al. ..... 439/814
7,084,727 B2 * 8/2006 Bauer et al. ..... 335/132
2002/0081914 A1 * 6/2002 Takaya et al. ..... 439/810
2005/0059271 A1 * 3/2005 Zhang ..... 439/74
2005/0270130 A1 * 12/2005 Roesner et al. ..... 335/132

FOREIGN PATENT DOCUMENTS

JP 09161861 6/1997

* cited by examiner

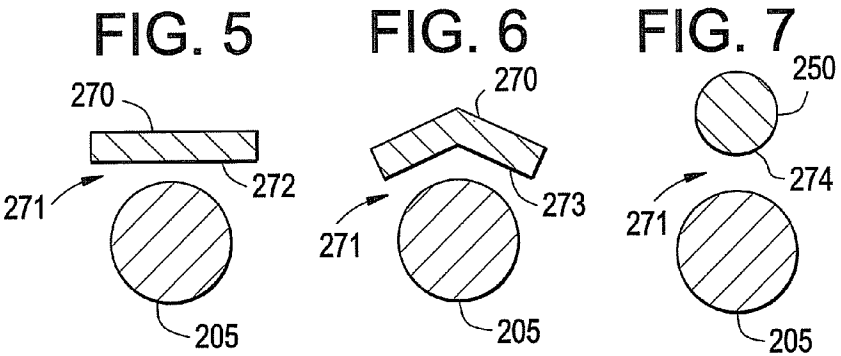
FIG. 7
250
274
205
271
FIG. 6
270
273
205
271
FIG. 5
272
270
205
271
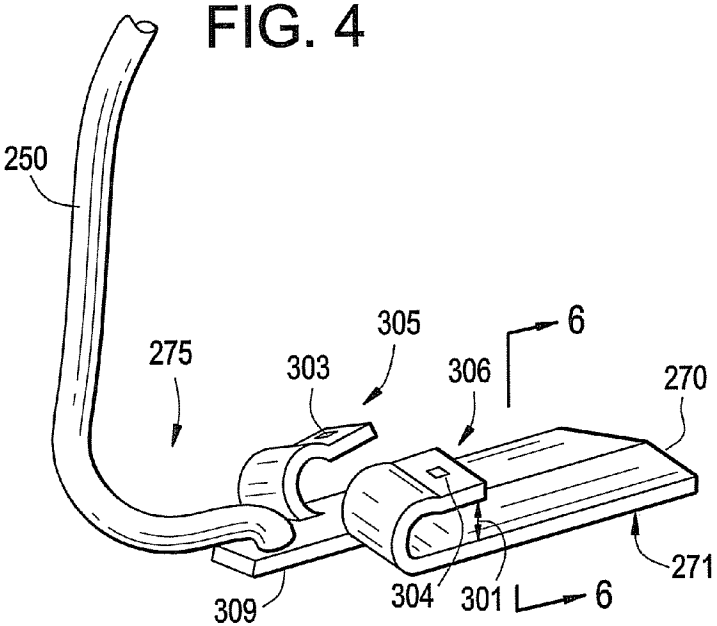
FIG. 4
270
271
6
6
306
301
304
305
303
309
275
250
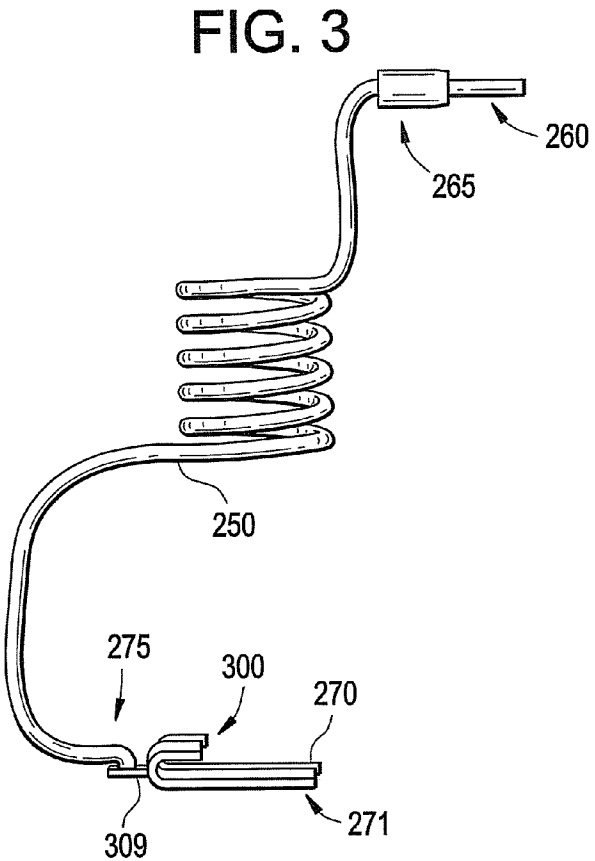
FIG. 3
260
265
250
270
271
300
275
309

SWITCHING APPARATUS

BACKGROUND OF THE INVENTION

The present disclosure relates generally to switching devices, and particularly to switching devices employing resistance wires.

The electrical current required to charge a capacitor is related to the capacitor's state of charge. In response to the capacitor having a fully discharged state, the charge current flowing into the capacitor will be at a maximum. As the state of capacitor charge increases, the charging current decreases, until the capacitor reaches a fully charged state, at which point the charging current will be zero. A fully discharged capacitor provides no restriction to the flow of charging current. Accordingly, switches (also herein referred to as contactors) for use with capacitors may include a parallel connected auxiliary switch that incorporates resistor wires to control the current flow within desired limits. These types of contactors are referred to as capacitor switching contactors.

Such switch arrangements are configured to incorporate a delay to close an auxiliary circuit (defined by the auxiliary switch and including the resistor wires) prior to closing a main circuit (absent the resistor wires). Therefore, the current to provide an initial charge to the capacitor is maintained at or below a desired limit by the resistor wires. Subsequently, in response to closing the main circuit, the charging current is controlled by the charge state of the capacitor.

Connection of the resistor wires between a set of main terminals and a set of auxiliary terminals may be accomplished utilizing a housing assembly. Such housings may incorporate individually insulated chambers, each chamber having a connecting terminal in connection with one of the resistance wires, and additional components configured to connect with the main terminals. Such housings may restrict airflow surrounding the resistance wire and obstruct access to the main terminals. Alternatively, a cylindrical resistor wire, absent the housing and additional components, maybe utilized in direct, mechanical contact adjoining a set of phase conductors within a connection space provided by each of the main terminals. Direct contact of the cylindrical resistance wire and phase conductor may not provide the strongest mechanical connection. Accordingly, there is a need in the art for a resistor wire arrangement that overcomes these drawbacks.

BRIEF DESCRIPTION OF THE INVENTION

An embodiment of the invention includes a switching apparatus. The apparatus comprises an electrical contactor including a set of main terminals per phase and an auxiliary switch including a set of auxiliary terminals per phase. Each set of the auxiliary terminals is electrically connected to a respective set of the main terminals via a resistance wire, such that each set of the auxiliary terminals is electrically connected in parallel with each respective set of the main terminals. Each resistance wire includes a first terminal at a first end configured to connect to one of the set of auxiliary terminals, and a second terminal at a second end configured to connect to a respective one of the set of main terminals. The second terminal of the resistance wire comprises a retention hook configured to hook onto the respective main terminal.

BRIEF DESCRIPTION OF THE DRAWINGS

Referring to the exemplary drawings wherein the elements are numbered alike in the accompanying Figures:

FIG. 3 depicts a side view of a resistance wire in accordance with an embodiment of the invention;

FIG. 4 depicts an enlarged front perspective view of a second terminal connector in accordance with an embodiment of the invention;

FIGS. 5, 6 and 7 depict cross sections of various contact surface geometries in accordance with embodiments of the invention;

DETAILED DESCRIPTION OF THE INVENTION

An embodiment of the invention provides a resistance wire having a single piece snap fit terminal, which is easy to manufacture and assemble. There are no housings and no additional connecting terminals used in conjunction with the resistance wire. The resistor terminal is directly snapped into the main terminal of the contactor. As compared with the resistance wire disposed within a housing, use of the snap fit terminal allows for a part count reduction and the avoidance of additional plastic housing parts. Use of a separate plastic module including complicated molds and extended terminals, an intermediate plastic housing, terminals, and connecting screws for housing the resistor wire and for terminating the resistor wire onto the main terminal of the contactor, may all be avoided.

Figure 1:
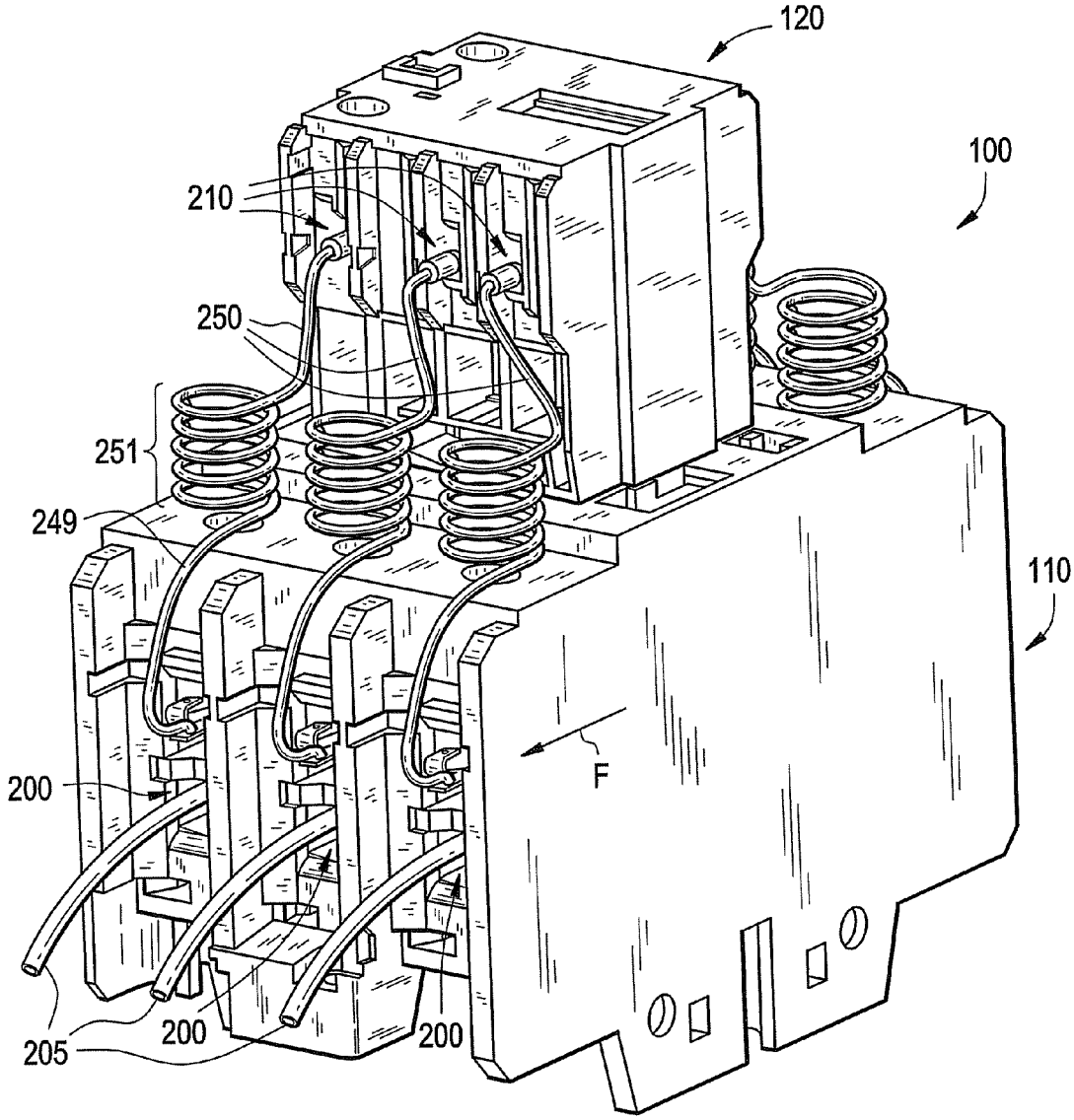
FIG. 1 depicts a front perspective view of a switching apparatus in accordance with an embodiment of the invention.

Referring now to FIG. 1, an exemplary embodiment of a switching apparatus 100 is depicted. The switching apparatus 100 includes an electrical contactor 110 and an auxiliary switch 120. The electrical contactor includes a set of main terminals 200 per each phase. The main terminals 200 are each configured to receive a phase conductor 205. The auxiliary switch 120 includes a set of auxiliary terminals 210 per phase. It will be appreciated that although the perspective in FIG. 1 depicts only three main terminals 200, auxiliary terminals 210, and phase conductors 205 on one end, the switching apparatus depicted in FIG. 1 has a complementary set of the above components disposed out of view at the other opposite end.

In an embodiment, each set of the auxiliary terminals 210 is electrically connected to the respective set of the main terminals 200 via a resistance wire 250, such that each set of the auxiliary terminals 210 is electrically connected in parallel with each respective set of the main terminals 200. In an embodiment, each resistance wire 250 is electrically insulated. In an embodiment, the electrical insulation comprises an insulation sleeve 249 that is applied to the exterior of each resistance wire 250.

In an embodiment, the resistance wires 250 each comprise a plurality of loops 251. The total length of the resistance wire 250 is determined by a desired resistance value. The loops 251 are configured to reduce the overall length between the auxiliary terminals 210 and the main terminals 200 required for the specific length of resistance wire 250 having the desired resistance value.

In an embodiment, the loops 251 are each configured and disposed above the openings of the main terminals 200 to provide unobstructed access by the end user to the main terminals 200. Disposition of the loops 251, absent a housing, above the main terminal 200 openings allow for simplified installation of the phase conductors 205, and also provide for an enhancement of the dissipation of any heat that may be generated by the phase conductors 205. The loops 251 are disposed such that each resistance wire 250 is exposed to the same ambient environment as the auxiliary switch 120, thereby enhancing the dissipation of any heat that may be generated by the resistance wire 250 in operation. In an alternate embodiment, the loops 251 are disposed such that each electrically insulated resistance wire 250 is exposed to the same ambient environment as the auxiliary switch 120.

While an embodiment of the invention has been depicted having a three phase switching apparatus, it will be appreciated that the scope of the invention is not so limited, and that invention also applies to other switching apparatuses having different numbers of phases, such as one, two, four, or more distinct phase paths, for example.

Figure 2:
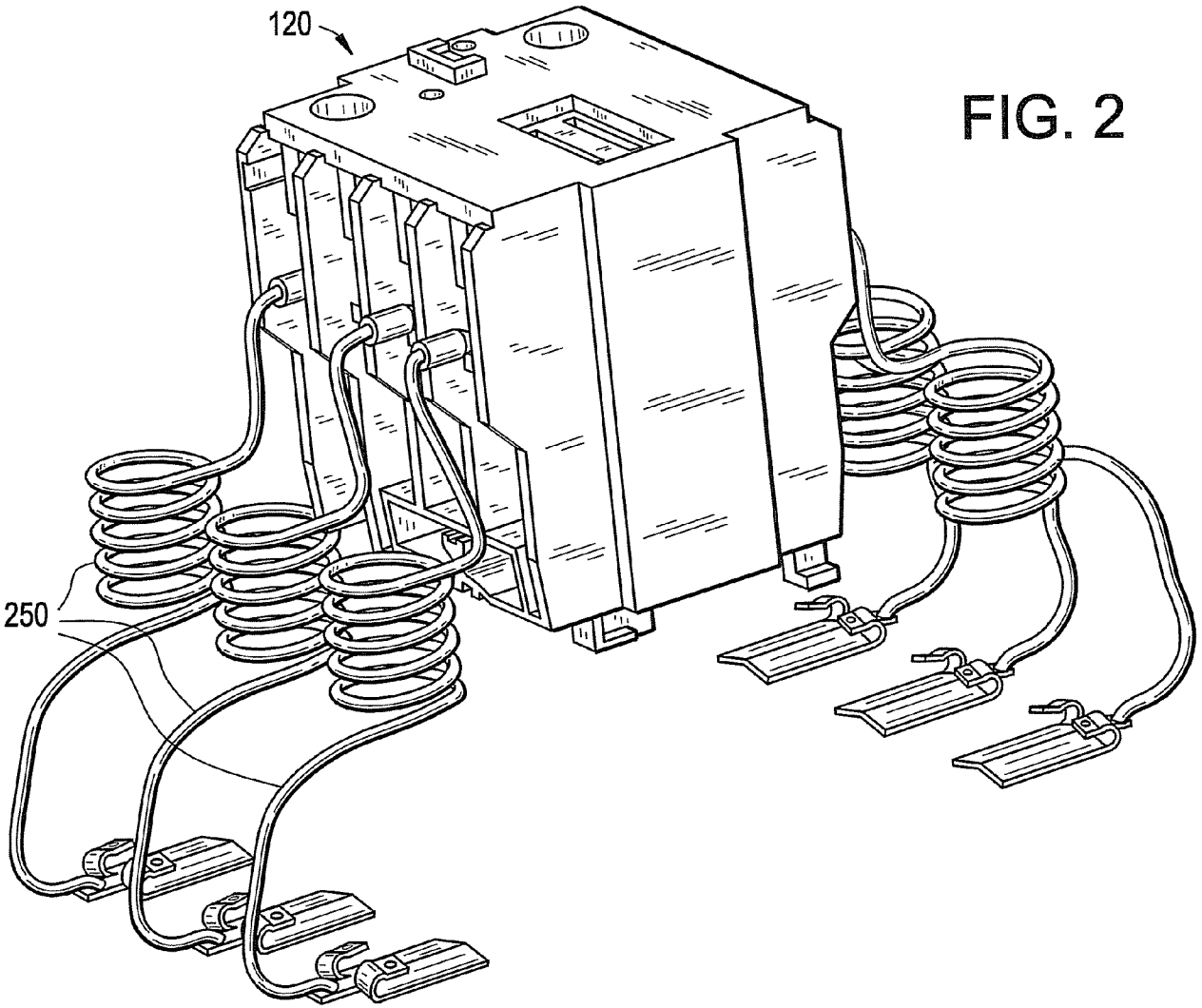
FIG. 2 depicts a front perspective view of an auxiliary switch and resistance wires in accordance with an embodiment of the invention.

Referring now to FIG. 2, an exemplary embodiment of the auxiliary switch 120 in connection with the resistance wires 250 is depicted.

Referring now to FIG. 3 with reference back to FIG. 1, a side view of an exemplary embodiment of the resistance wire 250 is depicted. Each resistance wire 250 includes a first terminal 260 at a first end 265, which is configured to connect to one of the set of auxiliary terminals 210. The resistance wire 250 also includes a second terminal 270 at a second end 275 configured to connect to a respective one of the set of main terminals 200. The second terminal 270 of the resistance wire 250 comprises a retention hook 300 configured to hook onto the respective main terminal 200. As used herein, reference numeral 300 will refer to retention hooks generally. The retention hook 300 comprises a connection tab 309 to provide electrical connection to the resistance wire 250. The second terminal 270 comprises a contact surface 271 disposed and configured to make contact with the phase conductor 205.

FIG. 4 depicts an enlarged perspective view of the second terminal 270. It may be appreciated from the perspective of FIG. 4 that in an exemplary embodiment, the second terminal 270 may have one of a concave and a flat contact surface 271.

Referring now to FIGS. 5, 6 and 7, cross sectional views of the cylindrical phase conductor 205 are depicted in relation to contact surfaces 271. It may be appreciated that a flat 272 contact surface 271 and a concave 273 contact surface 271, as provided by embodiments of the second terminal 270 will provide a greater area of contact than the convex 274 contact surface 271 that would be provided by the cylindrical resistance wire 250 in the absence of the second terminal 270. Accordingly, it may be appreciated that the flat 272 contact surface 271 and concave 273 contact surface 271 shall provide enhanced mechanical contact with the phase conductor 205.

While an embodiment of the invention has been depicted having a second terminal 270 with two retention hooks 300, it may be appreciated that the scope of the invention is not so limited, and that the invention also applies to other second terminals 270 having different numbers of retention hooks 300, such as one, three, four, or more retention hooks, for example.

Figure 8:
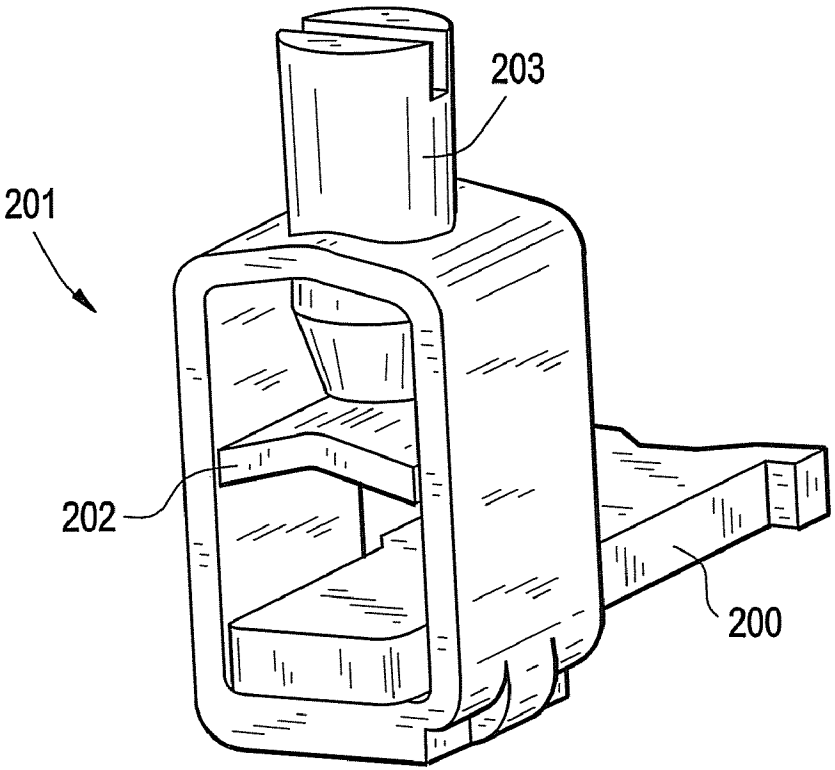
FIG. 8 depicts a side perspective view of a main terminal connector in accordance with embodiments of the invention.

Referring now to FIG. 8, an exemplary embodiment of a connector 201 in conjunction with one of the main terminals 200 is depicted. In an embodiment, each main terminal 200 comprises a connector 201 having a wire clamp 202 and a clamp screw 203. The phase conductor 205 (shown in FIG. 1) is inserted between the main terminal 200 and the wire clamp 202. As the clamp screw 203 is tightened, it provides compressive pressure to the wire clamp 202 to retain the phase conductor 205 between the wire clamp 202 and the main terminal 200. The clamp screw 203 is configured to withstand an application of at least 6.16 Nm of torque without damage thereto.

Referring now to FIG. 8 in conjunction with FIG. 4, it may be appreciated that the second terminal 270 is configured to be disposed adjacent the wire clamp 202, above the phase conductor 205 (not shown in FIG. 8). In an embodiment, the retention hooks 305, 306 are configured to slidably engage the wire clamp 202. In an embodiment, to increase the strength of the mechanical connection between the retention hooks 305, 306 and the wire clamp 202, the retention hooks 305, 306 are configured to slidably engage with the wire clamp 202 with a compressive load. The hooks 305, 306 are configured to have a dimension 301 that is less than the thickness of the wire clamp 202 to provide the compressive load. In an alternate embodiment, the retention hooks 305, 306 are configured to snap fit onto the wire clamp 202 to enhance the strength of the mechanical connection between the wire clamp 202 and the second terminal 270. The snap fit of the retention hooks 300 is provided by snap features 303, 304 disposed upon the retention hooks 305, 306. The snap features 303, 304 are configured to be protrusions extending from the retention hooks 305, 306 into the surface of the wire clamp 202.

While an embodiment of the invention has been depicted to provide a snap fit by having protrusions extending from the retention hooks 305, 306, it will be appreciated that the scope of the invention is not so limited, and that the invention also applies to alternate configurations to provide a snap fit, such as ribs, knurls, or protrusions extending from the wire clamp into recesses in the bottom of the retention hooks, for example.

Figure 9:
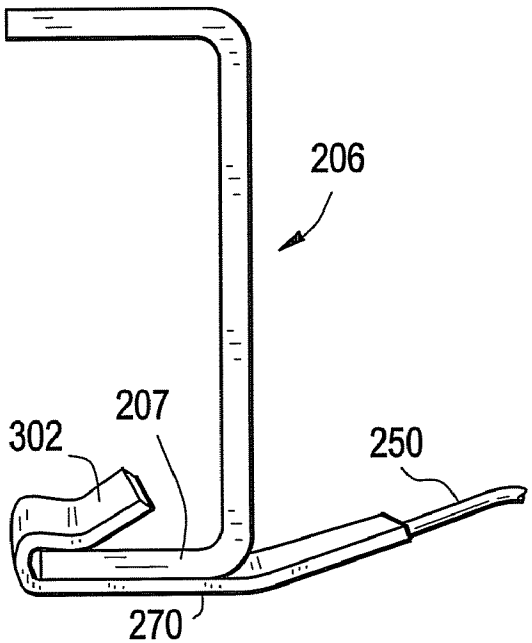
FIG. 9 depicts a side view of a main terminal connector in accordance with embodiments of the invention.

Referring now to FIG. 9, an alternate embodiment of the connector 206 of the main terminal 200 is depicted. The connector 206 comprises a connection tab 207. The retention hook 302 of the second terminal 270 is configured to snap fit onto the connection tab 207 with a compressive load.

The embodiments of the second terminal 270 described above are configured to ensure that the second terminal 270 and the terminal connector 201, 206 do not become disengaged or dislodged in response to connecting the phase conductor 205 to the main terminal 200. Each second terminal 270 is configured to withstand at least 10 kilograms of pullout force for at least one minute without becoming disengaged from the main terminal 200. Pullout force indicates a force that is applied directly to the resistance wire 250 to disengage it from the main terminal 200, as may be illustrated by the direction line F in FIG. 1. Further, the resistance wire 250 and second terminal 270 are configured to maintain a temperature below 65 degrees Celsius in response to the application of the amount of current for which the contactor 110 is rated.

As disclosed, some embodiments of the invention may include some of the following advantages: improved integrity of the resistor termination to ensure that the resistance wire remains connected with the main terminal; increased available space for the phase conductor to be terminated; improved resistance wire and phase conductor heat dissipation; reduced total cost resulting from fewer parts; and, increased ease of assembly using top-down assembly methods.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the scope of the appended claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A switching apparatus, comprising:

an electrical contactor including a set of main terminals per phase;

an auxiliary switch including a set of auxiliary terminals per phase, each set of the auxiliary terminals being electrically connected to a respective set of the main terminals via a resistance wire having a first end and a second end, such that each set of the auxiliary terminals is electrically connected in parallel with each respective set of the main terminals;

a first terminal connected to the first end of the resistance wire operative to engage one of the set of auxiliary terminals; and a second terminal member having a connection tab portion connected to the second end of the resistance wire and a retention hook portion extending distally from the connection tab portion operative to slidably engage one of the set of main terminals with a compressive load self induced by the retention hook portion; wherein each main terminal comprises a connector having a wire clamp; and the retention hook portion is configured to slidably engage the wire clamp.

2. The apparatus of claim 1, wherein the main terminals are each configured to receive a phase conductor, and flirt her wherein:

the second terminal comprises a contact surface disposed and configured to make contact with the phase conductor.

3. The apparatus of claim 2, wherein:

the contact surface comprises at least one of a flat contact surface and a concave contact surface.

4. The apparatus of claim 1, wherein:

the resistance wires each comprise a plurality of loops, the loops configured to reduce the overall length required for a specific length of wire.

5. The apparatus of claim 4, wherein:

the loops are each configured and disposed to provide unobstructed access to the main terminals.

6. The apparatus of claim 1, wherein:

each resistance wire is electrically insulated.

7. The apparatus of claim 6, wherein:

the electrical insulation comprises an insulation sleeve.

8. The apparatus of claim 1, wherein:

each resistance wire is exposed to the same ambient as the auxiliary switch.

9. The apparatus of claim 6, wherein:

each electrically insulated resistance wire is exposed to the same ambient as the auxiliary switch.

10. The apparatus of claim 1, wherein:

the retention hook portion is configured to slidably engage with the wire clamp with a compressive load.

11. The apparatus of claim 1, wherein:

each main terminal comprises a connector having a wire clamp; and the retention hook portion is configured to snap fit onto the wire clamp.

12. The apparatus of claim 1, wherein:

each main terminal comprises a connection tab; and the retention hook portion is configured to snap fit onto the connection tab with a compressive load.

13. The apparatus of claim 1, wherein:

each main terminal comprises a connector having a wire clamp and a clamp screw.

14. The apparatus of claim 1, wherein the retention hook portion includes a protrusion extending from a surface of the retention hook operative to engage the one of the set of main terminals.

* * * * *